US006199616B1

(12) United States Patent
Gillespie

(10) Patent No.: US 6,199,616 B1
(45) Date of Patent: Mar. 13, 2001

(54) CARPET REMOVER

(76) Inventor: Jerry J. Gillespie, 105 Main St., Raymond, NH (US) 03077

( * ) Notice: Subject to any disclaimer, the term of this patent is extended or adjusted under 35 U.S.C. 154(b) by 0 days.

(21) Appl. No.: 09/197,724

(22) Filed: Nov. 23, 1998

(51) Int. Cl.[7] ..... B32B 35/00
(52) U.S. Cl. ..... 156/584; 156/344; 254/203
(58) Field of Search ..... 156/344, 584; 254/200, 203, 210, 211

(56) References Cited

U.S. PATENT DOCUMENTS

| | | | |
|---|---|---|---|
| 1,186,729 | 6/1916 | Baker . | |
| 1,377,169 | 5/1921 | Maize . | |
| 1,599,966 | 9/1926 | Higgins et al. . | |
| 2,416,509 | 2/1947 | Beaulieu | 242/55.4 |
| 2,595,593 | 5/1952 | Manning | 242/56 |
| 2,655,976 | 10/1953 | Louvin | 154/1 |
| 3,830,441 | 8/1974 | McQuiston | 242/67.1 |
| 4,819,887 | 4/1989 | Dueck | 242/56 |
| 4,948,451 | 8/1990 | Foltz | 156/344 |
| 4,991,789 * | 2/1991 | Buerger | 242/400 X |
| 5,387,308 | 2/1995 | Heavrin | 156/584 |
| 5,415,725 | 5/1995 | Scharf | 156/584 |
| 5,454,899 | 10/1995 | Glenn et al. | 156/584 |
| 5,456,794 | 10/1995 | Barrett | 156/584 |
| 6,004,426 * | 12/1999 | Johnson | 156/344 |

FOREIGN PATENT DOCUMENTS

| | | | |
|---|---|---|---|
| 3002831 * | 7/1981 | (DE) | 156/584 |

* cited by examiner

*Primary Examiner*—Mark A. Osele
(74) *Attorney, Agent, or Firm*—Pierce Atwood; Patrick R. Scanlon

(57) ABSTRACT

A carpet remover is provided for quickly removing glued-down carpets. The carpet remover includes a rotary power source, particularly a power drive, a take-up shaft, and a coupling mechanism for rotatively connecting the shaft to the power source. The shaft has a means for securing an edge of the carpeting to the shaft. Thus, when the shaft is rotated by the power drive, the carpet is pulled from the floor and rolled up on the shaft. In a preferred embodiment, the shaft is sectional so that the overall shaft length can be changed in response to how firmly the carpet is adhered to the floor. In another preferred embodiment, the shaft can be broken down into arcuate segments and removed while the stripped carpet is still rolled up.

30 Claims, 5 Drawing Sheets

CARPET REMOVER

BACKGROUND OF THE INVENTION

This invention relates generally to devices for removing floor coverings and more particularly to a power-driven device for stripping carpets adhesively attached to a floor.

The use of adhesives to secure floor coverings such as carpet and linoleum to the underlying floor is common. Adhesives are used extensively to install carpet in office buildings and other commercial areas. However, carpeting installed with adhesive is typically very difficult to remove when the time comes for replacement. Manual removal of such carpeting is slow, labor-intensive and expensive. As a result, a number of mechanical and power-driven devices have been proposed for removing glued-down carpets more quickly. Many of these devices comprise large, complex systems that are difficult to transport and set up. Such large devices also require plenty of open space to operate and consequently do not work well in relatively confined spaces where carpeting is often found.

Accordingly, there is a need for a carpet-removing device that removes floor coverings quickly and efficiently, while still being easy to transport and use.

SUMMARY OF THE INVENTION

The above-mentioned needs are met by the present invention which provides a carpet remover having a rotary power source, particularly a power drive, a take-up shaft, and a coupling mechanism for rotatively connecting the shaft to the power source. The shaft has a means on its outer surface for securing a lead edge of a piece of glued-down carpet to the shaft. Thus, when the shaft is rotated by the power drive, the carpet is pulled from the floor and rolled up on the shaft. In a preferred embodiment, the shaft is sectional so that the overall shaft length can be changed in response to how firmly the carpet is adhered to the floor. In another preferred embodiment, the shaft can be broken down into arcuate segments and removed while the stripped carpet is still rolled up.

The present invention solves the problem of removing carpeting installed with adhesive by providing a device that is portable and simple to handle, easy to set up, strips carpeting quickly and is relatively inexpensive. The present invention is primarily directed to pulling up glued-down carpeting, but can also be used with non-glued carpeting and other types of floor coverings. The device is also useful in that one person can tightly roll up large pieces of loose carpet, a task that normally requires two or more people.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
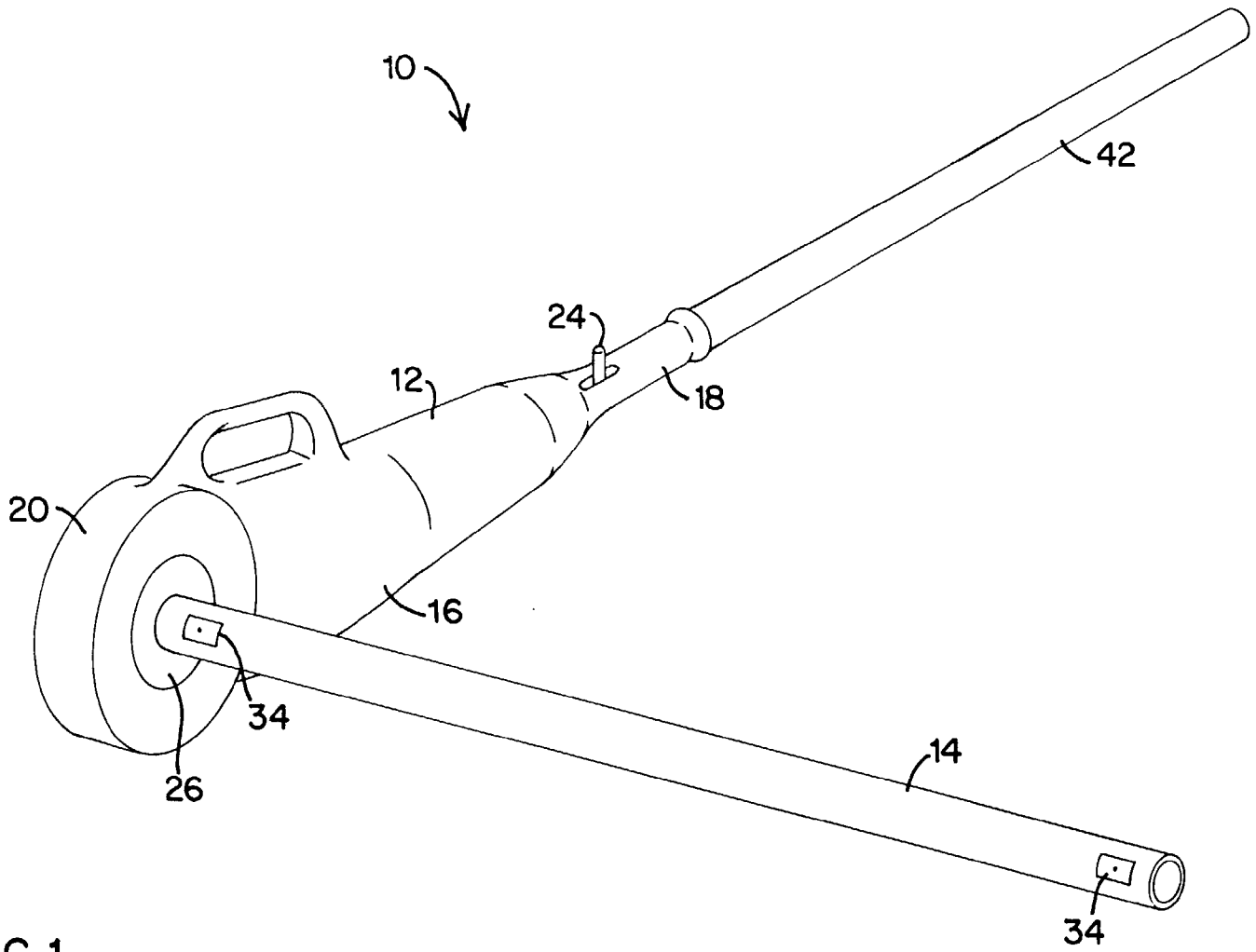
FIG. 1 is a perspective view of the carpet remover of the present invention.
Figure 2:
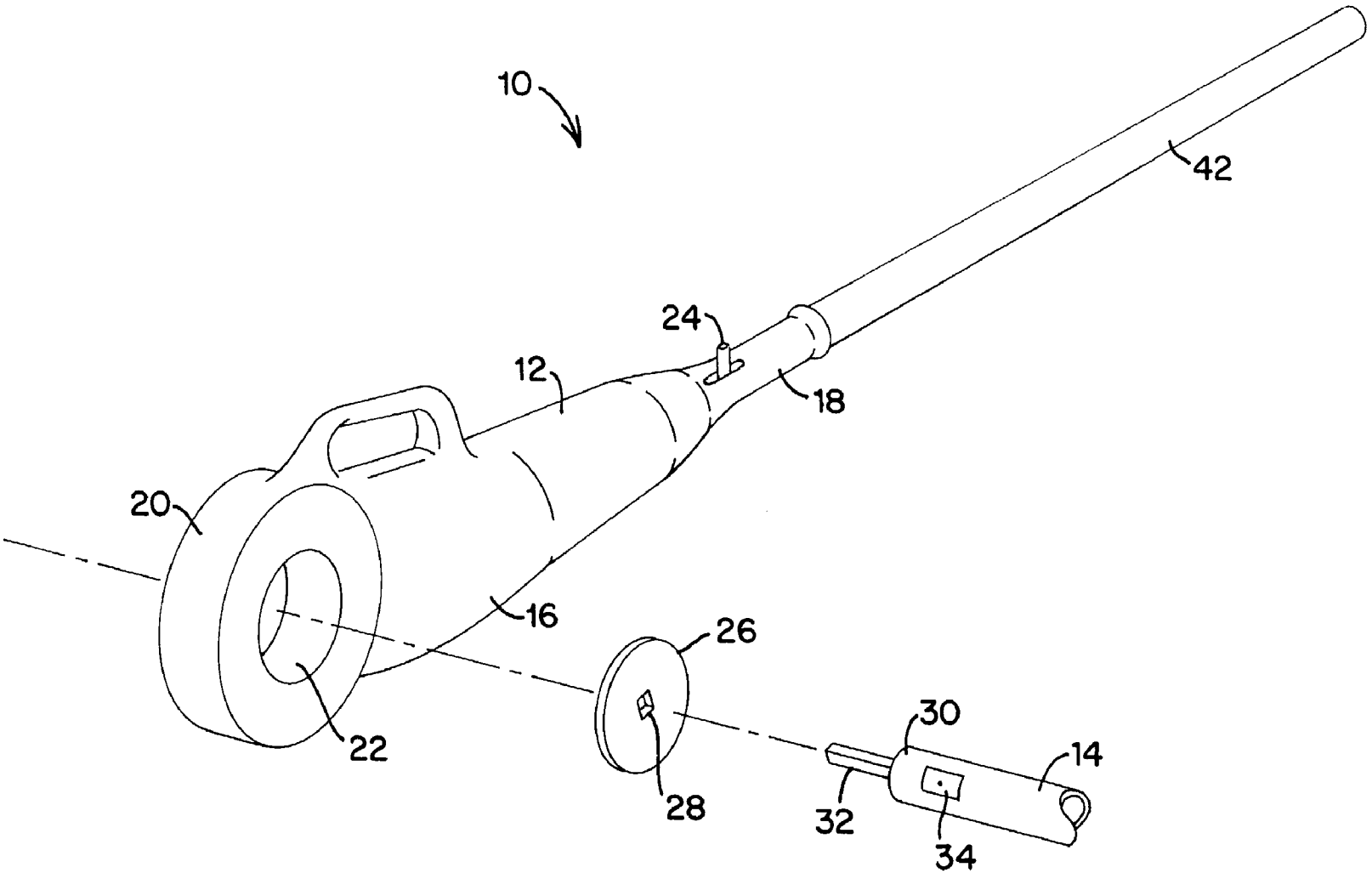
FIG. 2 is an exploded, partial perspective view of the carpet remover of FIG. 1.

Referring to the drawings wherein identical reference numerals denote the same elements throughout the various views, FIGS. 1 and 2 show the carpet remover 10 of the present invention. The carpet remover 10 includes a lightweight, portable power drive 12 and a take-up shaft 14 connected to and rotatively driven by the power drive 12. The power drive 12 is a conventional device widely used in the plumbing trade for threading pipes. An example of a commercially available portable power drive is the unit sold by The Ridge Tool Company of Elyria, Ohio as its Model No. 700 Portable Power Drive. This power drive, which has a ½ horsepower reversible motor and weighs about 31 pounds, has been found to be particularly suitable for use as the power source of the present invention. Other rotary power sources (such as drills) could be used in the present invention, but a portable power drive is preferred.

The power drive 12 has a casing 16 enclosing an electric motor (not shown). A handle 18 is formed at one end of the casing 16, and a circular-shaped head 20 is located at the other end of the casing 16. The head 20 supports a rotatable sleeve 22 that is caused to rotate about its longitudinal axis by the electric motor via gearing (not shown). A reversible switch 24 for controlling the direction of sleeve rotation is mounted on the handle 18. When using a power drive for pipe threading, a die head is placed in the rotatable sleeve 22. Such a die head is caused to rotate with the sleeve 22 by means of a pawl or detent mechanism (not shown). However, in the present invention, an adapter 26 is placed in the rotatable sleeve 22 for rotation therewith. The adapter 26 is a circular plate sized to fit snugly within the rotatable sleeve 22 and has a square aperture 28 formed in its center.

The take-up shaft 14 is preferably a hollow, cylindrical pipe being approximately three inches in diameter and in the range of about 3–12 feet long. As described more fully below, the shaft length is dependent in part on the resistance to stripping of the particular carpet being removed. The shaft 14 can be made of any suitable material, although aluminum is preferred. A first end 30 of the shaft 14 is provided with a coupler 32 that extends outward from the first end 30, along the shaft's longitudinal axis. The coupler 32 is a relatively short rod having a square cross section so as to fit into the square aperture 28 of the adapter 26. Thus, when the power drive 12 is activated, torque is transmitted by the adapter 26 to the shaft 14, causing it to rotate in the same direction as the rotatable sleeve 22.

A handle extender 42 can be attached lengthwise to the end of the handle 18 to provide additional leverage during operation of the carpet remover 10. The handle extender 42, which can be attached to the handle 18 in any conventional manner, is long enough so as to be able to be rested on the shoulder of a user while the head 20 of the power drive 12 is placed on or near the floor.

Figure 3:
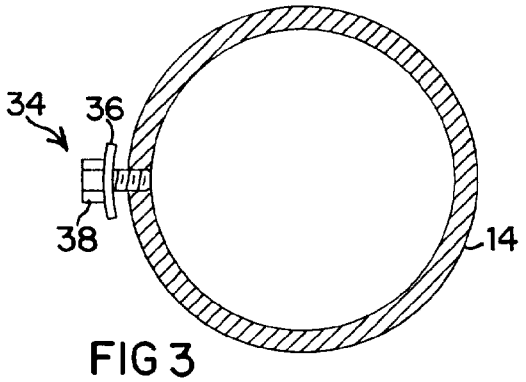
FIG. 3 is a sectional view of the take-up shaft in accordance with a first embodiment of the invention.
Figure 4:
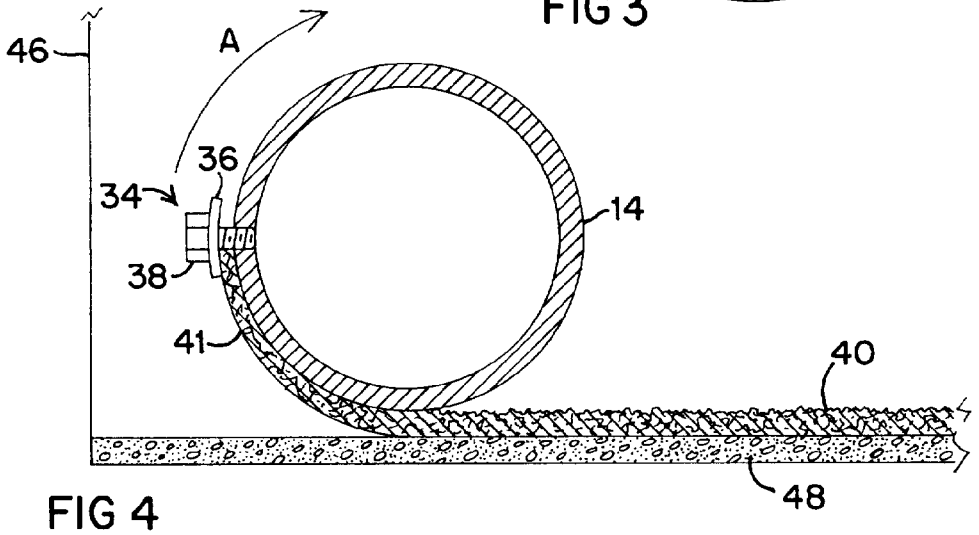
FIG. 4 is a sectional view of the take-up shaft attached to a piece of carpet.

Turning to FIGS. 3 and 4, a first embodiment of the take-up shaft 14 is shown. The outer cylindrical wall of the take-up shaft 14 is provided with a carpet clamp 34 adjacent each end of the shaft 14. The shaft 14 should have at least two clamps 34, although additional clamps can be included. All of the clamps 34 are aligned axially along the shaft 14. As shown in FIG. 3, each clamp 34 has a plate 36 curved to conform to the curvature of the shaft's outer wall. A fastener 38, such as a threaded bolt, is disposed through the plate 36 and received in an opening in the outer wall of the shaft 14. The fastener 38 threadingly engages threads formed in the shaft opening; or alternatively, the fastener 38 passes through the opening and threadingly engages a nut or other threaded member on the inside of the shaft 14. Either way, the fastener 38 can be tightened so that the plate 36 is pressed against the shaft 14. A carpet to be stripped is attached to the take-up shaft 14 by placing an edge 41 of the carpet 40 (FIG. 4) between the shaft 14 and the plate 36 of each clamp 34 and then tightening each fastener 38 so that the plates 36 firmly pinch the carpet 40 to the shaft 14. Inwardly projecting prongs (not shown) can be formed on the plates 36 to enhance carpet clamping. It is noted that although the preferred embodiment of clamps 34 have been described herein, other carpet securing means, such as the pointed prongs described below, could be used instead of the clamps 34.

The present invention can be used to remove just about any kind of floor covering, but is believed to be most useful in stripping adhesively installed carpet. To remove such carpet with the carpet remover 10, a short lead edge 41 of the carpet 40, typically adjacent a wall 46, is manually pulled from the floor 48, as shown in FIG. 4. The lead edge 41 should be about six inches long and have a width only slightly less than the length of the shaft 14. The carpet remover 10 is positioned so that the power drive 12 is located beside the lead edge 41 with the shaft 14 extending transversely over the lead edge 41 and substantially parallel to the wall 46. The head 20 of the power drive 12 should be positioned near or on the floor 48 with the handle 18 pointed upward. The lead edge 41 is brought from under the shaft 14 and clamped thereto by the carpet clamps 34. The operator grasps the handle 18 or handle extender 42, with the distal end of the handle extender 42 resting against his or her shoulder. The power drive 12 is then activated so that the shaft 14 rotates away from the wall 46 (in the direction of arrow A in FIG. 4), causing the carpet 40 to be pulled from the floor 48 and rolled onto the shaft 14. As the shaft 14 takes up the carpet 40, the operator walks along with the carpet remover 10, guiding it and turning it off when the strip of carpet is removed.

As mentioned above, the length of the shaft 14 can vary widely depending on the particular carpet being removed. For carpeting that is strongly adhered to the floor and presents great resistance to being pulled free, a shorter shaft length is more appropriate. This is because the amount of force needed to strip a piece of such carpet depends on how wide the piece is; by using a shorter shaft length, the carpet remover 10 will be pulling a narrower piece of carpet. Where the adhesion to the floor is not as strong and less force is required to strip a given width of carpet, then a longer shaft length could be used in order to pull up as much carpet at a time as possible. Preferably, the shaft length will range from approximately three feet for the most difficult applications to about 12 feet for easier applications. To accommodate differences in carpet stripping resistance, the carpet remover 10 can be furnished with a plurality of interchangeable shafts 14 of varying lengths.

Figure 6:
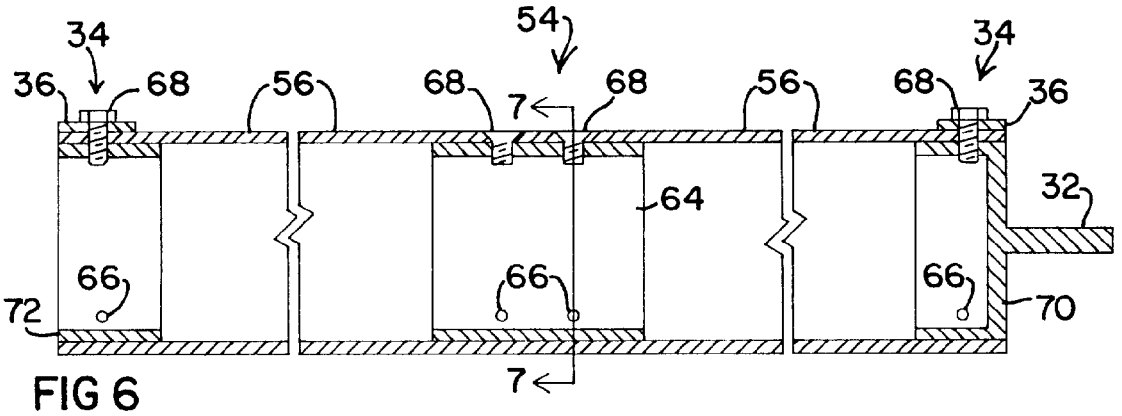
FIG. 6 is a partial sectional view of the take-up shaft of FIG. 5.
Figure 7:
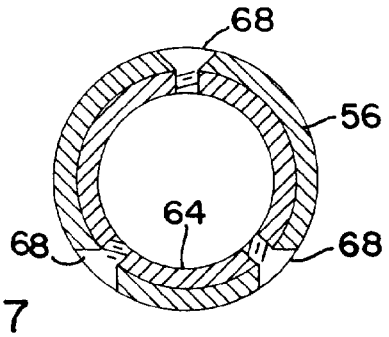
FIG. 7 is a sectional view taken along the line 7—7 of FIG. 6.
Figure 5:
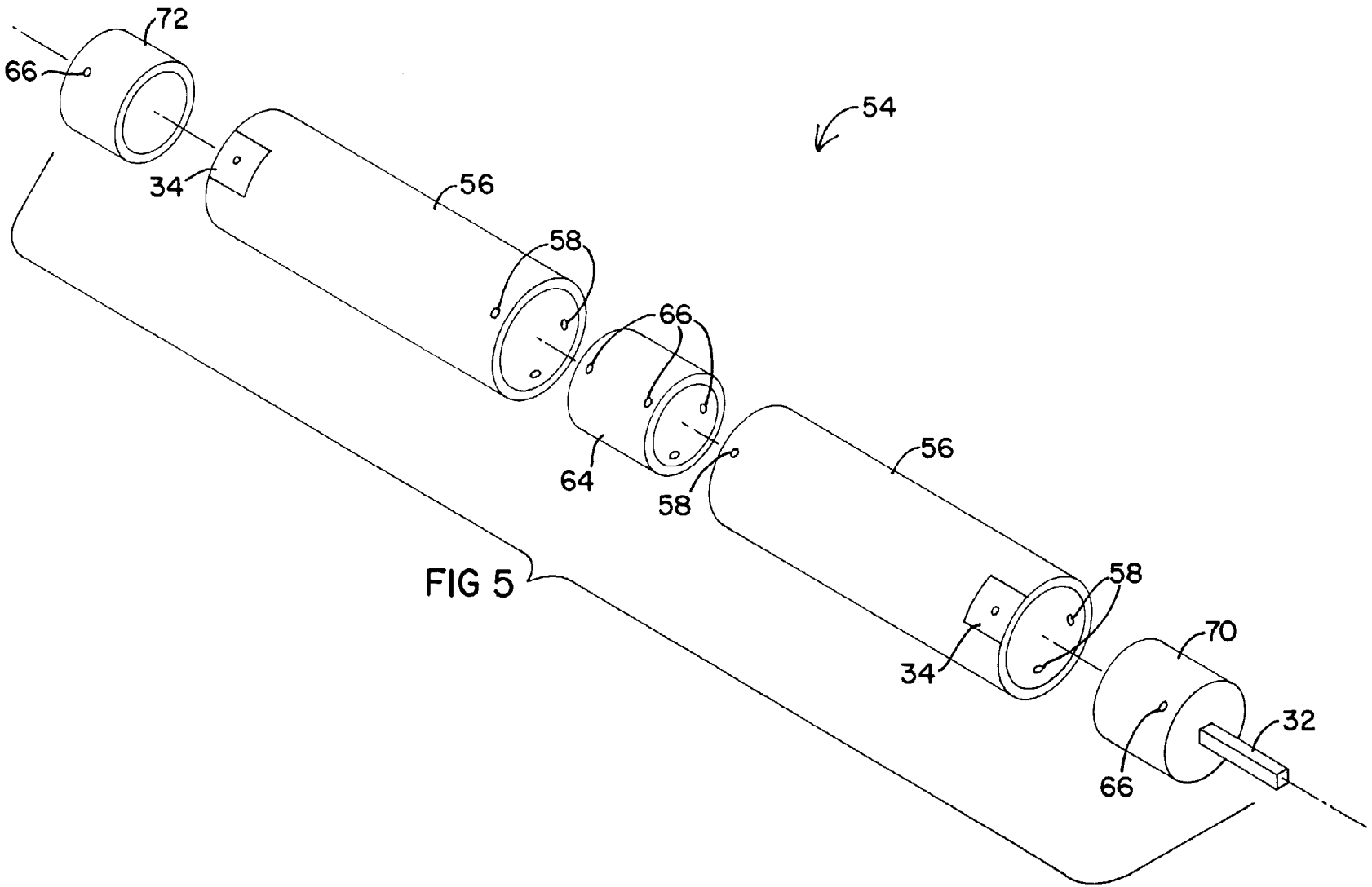
FIG. 5 is an exploded perspective view of the take-up shaft in accordance with a second embodiment of the invention.

FIGS. 5–7 show a second embodiment of the take-up shaft which provides an alternative approach to accommodating differences in carpet adhesion. In this embodiment, a multi-piece shaft 54 is provided. The multi-piece shaft 54 includes a plurality of interconnecting shaft sections 56, one or more of which can be used selectively in the manner described below to vary the overall length of the multi-piece shaft 54. Each shaft section 56 is preferably a hollow, cylindrical pipe made of any suitable material such as aluminum and has a length of about three feet and a diameter of about three inches. Two sets of screw holes 58 are formed in each shaft section 56, one set being located near one end and the other set being located near the other end of each shaft section 56. The screw holes 58 in each set are equally spaced around the circumference of the shaft sections 56 and preferably, although not necessarily, number three.

When using more than one of the shaft sections 56, they are connected together in a lengthwise fashion using a connector piece 64. While only two shaft sections 56 are depicted in FIG. 5 for convenience of illustration, it should be noted that additional shaft sections 56 could be added using additional connector pieces 64. The connector piece 64 is a short length of pipe having an outer diameter that fits snugly within the inner diameter of the shaft sections 56. The connector piece 64 has a set of threaded holes 66 formed therein at both ends. The holes 66 within each set are spaced equally around the circumference of the connector piece 64. The number of threaded holes 66 in each set is equal to the number of screw holes 58 found in each set on the shaft sections 56. The connector piece 64 can be made of aluminum or another suitable material such as steel.

As best seen in FIGS. 6 and 7, a shaft section 56 is attached lengthwise to another shaft section 56 by inserting one end of the connector piece 64 into one end of one of the shaft sections 56 so that the threaded holes 66 align with the screw holes 58. A fastener 68, such as an Allen screw, is inserted through each screw hole 58 and threadingly engages the corresponding threaded hole 66 to secure the connector piece 64 to the shaft section 56. The screw holes 58 are countersunk so that the heads of the fasteners 68 will be received therein. Next, the other end of the connector piece 64 is inserted into one end of the other shaft section 56 so that the corresponding threaded holes 66 and screw holes 58 are aligned and the two shaft sections 56 abut one another. Fasteners 68 are used to secure the other shaft section 56 to the connector piece 66, thus connecting the two shaft sections 56 together. The overall length of the shaft 54 can be further increased by connecting additional shaft sections 56 with additional connector pieces 64 in the same manner.

Regardless of how many shaft sections 56 are used, the multi-piece shaft 54 also includes a first end cap 70 disposed on one end thereof and a second end cap 72 disposed on the other end. The first end cap 70 is a short length of pipe having an outer diameter that fits snugly within the inner diameter of the shaft sections 56. The first end cap 70 has a set of threaded holes 66 formed at one end thereof. The holes 66 are spaced equally around the circumference of the first end cap 70 and are equal in number to the screw holes 58 formed in each end of the shaft sections 56. The first end cap 70 can be made of any suitable material such as aluminum or steel. The other end of the first end cap 70 is closed and has a coupler 32 extending outwardly therefrom for connection to the square aperture 28 of the adapter 26. The first end cap 70 is inserted into one end of the multi-piece shaft 54 with the threaded holes 66 aligned with the screw holes 58 and attached thereto with fasteners 68.

Similarly, the second end cap 72 is also a short length of pipe having an outer diameter that fits snugly within the inner diameter of the shaft sections 56 and a set of threaded holes 66 formed at one end thereof. The holes 66 are spaced equally around the circumference of the second end cap 72 and are equal in number to the screw holes 58 formed in each end of the shaft sections 56. The second end cap 72 is inserted into the end of the multi-piece shaft 54 opposite the first end cap 70 with the threaded holes 66 aligned with the screw holes 58 and attached thereto with fasteners 68. As shown in FIG. 6, each end of the shaft 54 is provided with a carpet clamp 34. Each clamp 34 has a plate 36 curved to conform to the curvature of the shaft's outer wall. Each plate 36 is adjustably attached to the respective end of the shaft 54 by one of the fasteners 68 which is disposed through the plate 36 and threadingly engages a threaded hole 66 in the first end cap 70 and the second end cap 72, respectively.

The multi-piece shaft 54 provides an easy way to adjust the shaft length of the carpet remover 10 as appropriate, considering how strongly the carpet is adhered to the floor. For the most strongly installed carpets, a single shaft section 58 could be used with end caps to provide the shortest shaft length. For less strongly installed carpets, extension sections 58 can be added as needed to incrementally increase the shaft length. As mentioned above, the base sections 56 are preferably three feet long so that the multi-piece shaft 54 could be varied in three-foot increments. However, other section lengths are possible.

Figure 8:
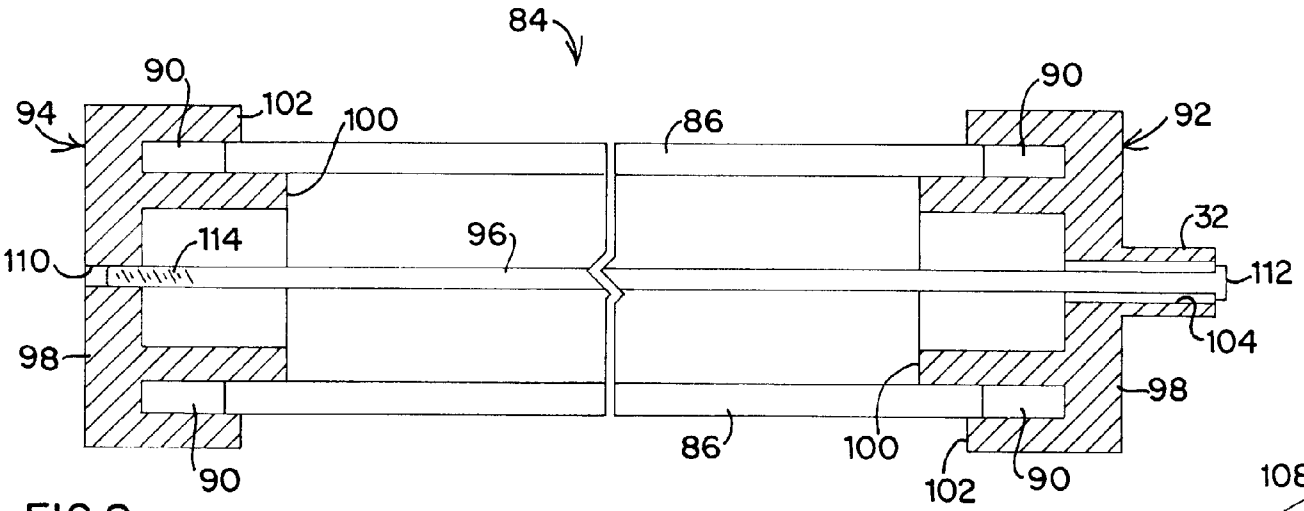
FIG. 8 is a partial sectional view of the take-up shaft in accordance with a third embodiment of the invention.
Figure 10:
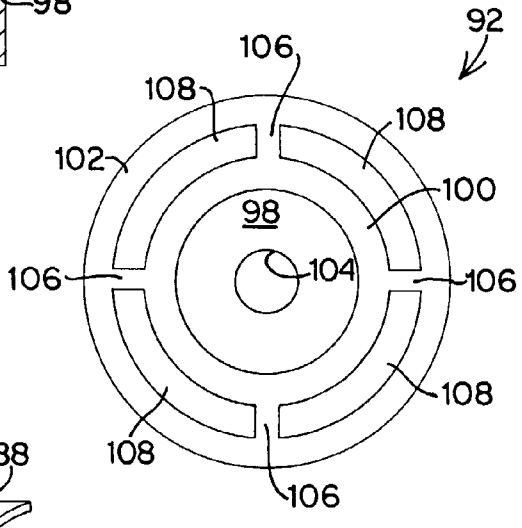
FIG. 10 is an end view of an end cap of the take-up shaft of FIG. 8.
Figure 9:
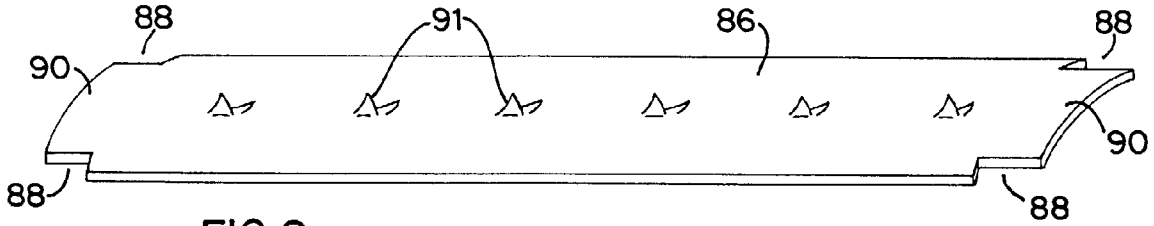
FIG. 9 is a perspective view of a segment of the take-up shaft of FIG. 8.

Turning now to FIGS. 8–10, a take-up shaft 84 in accordance with a third embodiment is shown. The shaft 84 includes a plurality of arcuate segments 86 which are arranged in a side-to-side relationship to define a generally hollow, cylindrical form. Preferably, three segments 86, each defining a 120° arc, or four segments 86, each defining a 90° arc, are used. As best seen in FIG. 9, each segment 86 has a notch 88 formed at each corner thereof to define an extension 90 at both ends of the segment 86. Thus, when all of the segments 86 are arranged side-to-side in a cylindrical form, adjacent notches will define a gap, the purpose of which will be presently described. Each segment 86 is preferably about 3–12 feet long, with a length of about six feet being most preferred. Each notch 88 preferably extends about one-eighth inch in from the sides of the segments 86 and about six inches in from the ends of the segments 86. A series of pointed prongs 91 is formed on the convex side of each segment 86. The prongs 91 are arranged lengthwise along the segment 86 and point in a substantially tangential direction with respect to the curvature of the arcuate segment 86.

The segments 86 are retained in the cylindrical form by means of a first end cap 92, a second end cap 94 and a tie rod 96. The first end cap 92 includes a circular base portion 98 having an inner sleeve 100 and an outer sleeve 102 extending outwardly from one side thereof. A square coupler 32 for connection with the aperture 28 of the adapter 26 extends outwardly from the side of base portion 98 opposite the sleeves 100 and 102. A bore 104 for receiving the tie rod 96 extends through the coupler 32 and the base portion 98. The inner and outer sleeves 100 and 102 are spaced apart and concentric with each other. A plurality of narrow beams 106 (best seen in FIG. 10) are disposed between the inner and outer sleeves 100 and 102. The beams 106 extend parallel to the axis of the first end cap 92 so as to define a number of arcuate gaps 108 between the inner and outer sleeves 100 and 102. The width of the beams 106 matches the width of the gaps defined by adjacent notches 88 of the segments 86 so that one of the extensions 90 formed on the ends of the segments 86 will fit into one of the arcuate gaps 108. Thus, the number of beams 106, and hence gaps 108, is equal to the number of segments 86.

The second end cap 94 is similar to the first end cap 92 in that it has a circular base 98 and inner and outer concentric sleeves 100 and 102 that define a number of arcuate gaps, separated by beams, which receive the extensions 90 on the other end of the segments 86. Instead of the coupler 32 of the first end cap 92, the second end cap 94 has a threaded hole 110 in its circular base 98. To assemble the shaft 84 for operation, all of the segments 86 are arranged side-to-side in cylindrical form (with the prongs 91 of each segment pointing in the same tangential direction), and the first end cap 92 is placed on the extensions 90 on one end of the segments 86 and the second end cap 94 is placed on the extensions 90 on the other end of the segments 86 so as to maintain the segments 86 in the cylindrical form. The tie rod 96, which has a head 112 at one end and threads 114 at the other end, is inserted through the bore 104 so that the threads 114 engage the threaded hole 110. Tightening the tie rod 96 so that the head 112 abuts the end of the coupler 32, will force the end caps 92 and 94 towards one another, thereby retaining them on the segments 86 to form a functional shaft 84. Alternatively, the head 112 could be replaced with a separate nut that threadingly engages the tie rod 96.

In operation, the shaft 84 is connected to the power drive 12 via the coupler 32 and the adapter 26. A short lead edge of the carpet to be removed is then hooked onto the prongs 91 of one or more of the segments 86 to secure the carpet to the shaft 84, and the power drive 12 is activated so that the shaft 84 rotates, causing the carpet to be stripped and rolled onto the shaft 84. Once the carpet has been rolled up, the power drive 12 is detached from the shaft 84 and the tie rod 96 is loosened and removed. The end caps 92 and 94 are then removed, using a slide hammer if necessary. With the caps 92 and 94 removed, the segments 86 are not held in their cylindrical arrangement and can thus be easily pulled out of the roll of carpet. Accordingly, the shaft 84 can be removed and used for another job without having to unroll the stripped carpet.

The foregoing has described a carpet remover that is relatively compact, lightweight and easy to use, but is still powerful enough to remove glued carpeting quickly and effectively. While specific embodiments of the present invention have been described, it will be apparent to those skilled in the art that various modifications thereto can be made without departing from the spirit and scope of the invention as defined in the appended claims.

What is claimed is:

1. A device for use with a rotary power source to strip floor coverings, said device comprising:

a shaft including a plurality of interconnecting shaft sections;

a coupling mechanism for connecting said shaft to a rotary power source so that said shaft will be rotated by said power source; and means for securing a floor covering to said shaft.

2. The device of claim 1 wherein said coupling mechanism comprises a coupler extending longitudinally from one end of said shaft.

3. The device of claim 1 wherein said means for securing comprises at least one clamp attached to said shaft.

4. The device of claim 3 wherein said at least one clamp comprises a plate and a fastener for holding said plate against said shaft.

5. The device of claim 1 wherein said means for securing comprises a series of pointed prongs pointing in a substantially tangential direction with respect to said shaft.

6. The device of claim 1 further comprising at least one connector piece for connecting two of said shaft sections .

7. A device for removing floor coverings, said device comprising:

a power drive having a handle and a rotatable sleeve;

a shaft;

a coupling mechanism for connecting said shaft to said power drive so that said shaft will be rotated by said power drive; and means for securing a floor covering to said shaft.

8. The device of claim 7 wherein said coupling mechanism comprises a coupler extending longitudinally from one end of said shaft and an adapter having an aperture therein for receiving said coupler, said adapter being sized to fit in said rotatable sleeve.

9. The device of claim 7 further comprising an extender attached to said handle of said power drive.

10. The device of claim 7 wherein said means for securing comprises at least one clamp attached to said shaft.

11. The device of claim 10 wherein said at least one clamp comprises a plate and a fastener for holding said plate against said shaft.

12. The device of claim 7 wherein said means for securing comprises a series of pointed prongs pointing in a substantially tangential direction with respect to said shaft.

13. The device of claim 7 further comprising at least one additional shaft, said additional shaft being attached to one end of said shaft.

14. The device of claim 13 further comprising means for securing a floor covering to said additional shaft.

15. The device of claim 7 wherein said shaft comprises a plurality of interconnecting shaft sections.

16. The device of claim 15 further comprising at least one connector piece for connecting two of said shaft sections.

17. The device of claim 7 wherein said shaft comprises a plurality of arcuate segments.

18. The device of claim 17 wherein said plurality of segments is arranged in a cylindrical form and said shaft further comprises a first end cap disposed on one end of said segments and a second end cap disposed on another end of said segments.

19. The device of claim 18 wherein said shaft further comprises a tie rod extending between said first and second end caps.

20. The device of claim 18 wherein said first and second end caps each comprise a pair of spaced apart, concentric sleeves, said segments being located between said pairs of sleeves.

21. The device of claim 20 further comprising a plurality of beams being disposed between each pair of sleeves, said segments having notches formed therein to accommodate said beams.

22. The device of claim 18 wherein said coupling mechanism comprises a coupler extending longitudinally from said first end cap.

23. The device of claim 17 wherein said means for securing comprises a series of pointed prongs formed on at least one of said segments, said prongs pointing in a substantially tangential direction with respect to said shaft.

24. A device for use with a rotary power source to strip floor coverings, said device comprising:

a shaft comprising a plurality of arcuate segments;

a coupling mechanism for connecting said shaft to a rotary power source so that said shaft will be rotated by said power source; and means for securing a floor covering to said shaft.

25. The device of claim 24 wherein said plurality of segments is arranged in a cylindrical form and said shaft further comprises a first end cap disposed on one end of said segments and a second end cap disposed on another end of said segments.

26. The device of claim 25 wherein said shaft further comprises a tie rod extending between said first and second end caps.

27. The device of claim 25 wherein said first and second end caps each comprise a pair of spaced apart, concentric sleeves, said segments being located between said pairs of sleeves.

28. The device of claim 27 further comprising a plurality of beams being disposed between each pair of sleeves, said segments having notches formed therein to accommodate said beams.

29. The device of claim 25 wherein said coupling mechanism comprises a coupler extending longitudinally from said first end cap.

30. The device of claim 24 wherein said means for securing comprises a series of pointed prongs formed on at least one of said segments, said prongs pointing in a substantially tangential direction with respect to said shaft.

* * * * *